US009083107B2

(12) United States Patent
Suzuki et al.

(10) Patent No.: US 9,083,107 B2
(45) Date of Patent: Jul. 14, 2015

(54) CONNECTOR

(71) Applicant: Yazaki Corporation, Tokyo (JP)

(72) Inventors: Toru Suzuki, Kakegawa (JP); Hajime Kato, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 12 days.

(21) Appl. No.: 14/136,517

(22) Filed: Dec. 20, 2013

(65) Prior Publication Data

US 2014/0106588 A1 Apr. 17, 2014

Related U.S. Application Data

(63) Continuation of application No. PCT/JP2012/066052, filed on Jun. 22, 2012.

(30) Foreign Application Priority Data

Jun. 23, 2011 (JP) ..... 2011-139425

(51) Int. Cl.
*H01R 13/52* (2006.01)
*H01R 11/32* (2006.01)

(52) U.S. Cl.
CPC ..... *H01R 13/5202* (2013.01); *H01R 13/5219* (2013.01); *H01R 11/32* (2013.01)

(58) Field of Classification Search
CPC . H01R 13/5202; H01R 13/5219; H01R 11/32
USPC ..... 439/721, 723, 724
See application file for complete search history.

(56) References Cited

U.S. PATENT DOCUMENTS 4,354,726 A * 10/1982 Kato et al. ..... 439/763
5,171,169 A * 12/1992 Butcher et al. ..... 439/755
5,599,210 A * 2/1997 Green ..... 439/763
5,688,131 A * 11/1997 Byfield, Jr. ..... 439/92
6,189,769 B1 * 2/2001 Kuo ..... 228/205
6,322,376 B1 * 11/2001 Jetton ..... 439/76.2

(Continued)

FOREIGN PATENT DOCUMENTS

CN 101409400 A 4/2009
EP 1 605 548 A1 12/2005

(Continued)

OTHER PUBLICATIONS

International Search Report dated Jul. 24, 2012 issued in International Application No. PCT/JP2012/066052 (PCT/ISA/210).

(Continued)

*Primary Examiner* — Ross Gushi
(74) *Attorney, Agent, or Firm* — Sughrue Mion, PLLC

(57) ABSTRACT

A connector includes a plurality of connection terminals, a housing, an installing part and a sealing member. Cables are connected to the connection terminals. The housing holds the connection terminals. The installing part is formed by a part of the housing, and is fitted into a mounting hole of a connection counterpart. The sealing member is provided in the installing part, and seals between the installing part and the mounting hole. Connecting tab parts provided in the connection terminals are connected to a terminal block provided at the connection counterpart side. The connection terminals includes a confluent connection terminal including a plurality of cable connecting parts to which a plurality of the cables are connected and one of the connecting tab parts.

3 Claims, 7 Drawing Sheets

(56) References Cited

U.S. PATENT DOCUMENTS

| | | | | |
|---|---|---|---|---|
| 6,334,797 | B1 * | 1/2002 | Liang | 439/763 |
| 6,364,720 | B1 * | 4/2002 | Liang | 439/764 |
| 6,494,752 | B1 * | 12/2002 | Liang | 439/764 |
| 6,764,353 | B2 * | 7/2004 | Freitag | 439/763 |
| 6,786,777 | B2 * | 9/2004 | Sakatani | 439/677 |
| 6,840,820 | B2 * | 1/2005 | Oda | 439/724 |
| 6,960,723 | B2 * | 11/2005 | Fujii et al. | 174/84 C |
| 6,969,285 | B2 * | 11/2005 | Kobayashi | 439/723 |
| 7,041,907 | B2 * | 5/2006 | Miyazaki | 174/72 A |
| 7,059,918 | B2 * | 6/2006 | Matsumoto et al. | 439/752 |
| 7,115,006 | B2 * | 10/2006 | Onuma | 439/881 |
| 7,351,123 | B1 * | 4/2008 | Winiecke | 439/883 |
| 7,422,491 | B2 * | 9/2008 | Gherardini | 439/721 |
| 7,438,605 | B1 * | 10/2008 | Huang et al. | 439/711 |
| 7,540,772 | B2 * | 6/2009 | Sardi et al. | 439/581 |
| 7,572,150 | B2 * | 8/2009 | Matsuoka | 439/626 |
| 7,591,660 | B1 * | 9/2009 | Eichhorst | 439/212 |
| 7,597,580 | B1 | 10/2009 | Advey et al. | |
| 7,722,372 | B2 * | 5/2010 | Matsumoto et al. | 439/213 |
| 7,811,116 | B2 * | 10/2010 | Sakakura et al. | 439/364 |
| 7,988,475 | B2 * | 8/2011 | Sakakura | 439/271 |
| 8,025,538 | B2 * | 9/2011 | Hara et al. | 439/723 |
| 8,100,730 | B2 * | 1/2012 | Hara et al. | 439/721 |
| 8,105,103 | B2 * | 1/2012 | Nishio et al. | 439/287 |
| 8,118,613 | B2 * | 2/2012 | Rapp et al. | 439/585 |
| 8,187,030 | B2 * | 5/2012 | Matsuoka et al. | 439/542 |
| 8,342,880 | B2 * | 1/2013 | Kato et al. | 439/595 |
| 8,366,499 | B2 * | 2/2013 | Shuey et al. | 439/883 |
| 8,408,927 | B2 * | 4/2013 | Tashiro | 439/247 |
| 8,425,256 | B2 * | 4/2013 | Aoki et al. | 439/620.26 |
| 8,449,323 | B2 * | 5/2013 | Omae et al. | 439/559 |
| 8,485,844 | B2 * | 7/2013 | Omae et al. | 439/559 |
| 8,545,265 | B2 * | 10/2013 | Sakamoto et al. | 439/606 |
| 8,562,377 | B2 * | 10/2013 | Kawamura | 439/607.44 |
| 8,563,862 | B2 * | 10/2013 | Mochizuki | 174/84 C |
| 8,647,155 | B2 * | 2/2014 | Hung | 439/658 |
| 8,648,507 | B2 * | 2/2014 | Chamberlin et al. | 310/71 |
| 8,740,655 | B2 * | 6/2014 | Kato et al. | 439/736 |
| 8,794,982 | B2 * | 8/2014 | Yamamoto et al. | 439/76.2 |
| 8,803,006 | B2 * | 8/2014 | Imahori et al. | 174/539 |
| 8,821,184 | B2 * | 9/2014 | Yu et al. | 439/512 |
| 8,851,935 | B2 * | 10/2014 | Yoshioka et al. | 439/694 |
| 8,894,449 | B2 * | 11/2014 | Matsumoto et al. | 439/727 |
| 2002/0134565 | A1 | 9/2002 | Hashizawa et al. | |
| 2009/0098779 | A1 | 4/2009 | Kawamura | |
| 2013/0323958 | A1 * | 12/2013 | Nakashima et al. | 439/350 |
| 2014/0038444 | A1 * | 2/2014 | Morikawa | 439/284 |
| 2014/0060877 | A1 * | 3/2014 | Yamamoto et al. | 174/59 |
| 2014/0106588 | A1 * | 4/2014 | Suzuki et al. | 439/271 |
| 2014/0120767 | A1 * | 5/2014 | Itsuki et al. | 439/587 |
| 2014/0134869 | A1 * | 5/2014 | Hamai et al. | 439/345 |
| 2014/0187081 | A1 * | 7/2014 | Teramoto | 439/527 |
| 2014/0220792 | A1 * | 8/2014 | Omori et al. | 439/34 |
| 2014/0235078 | A1 * | 8/2014 | Omori et al. | 439/98 |
| 2014/0235090 | A1 * | 8/2014 | Omori et al. | 439/350 |
| 2014/0295709 | A1 * | 10/2014 | Tanaka et al. | 439/626 |
| 2014/0305696 | A1 * | 10/2014 | Tanaka et al. | 174/71 R |
| 2014/0315410 | A1 * | 10/2014 | Omori et al. | 439/271 |
| 2014/0377975 | A1 * | 12/2014 | Omori et al. | 439/284 |
| 2015/0050826 | A1 * | 2/2015 | Tashiro et al. | 439/278 |

FOREIGN PATENT DOCUMENTS

| | | | |
|---|---|---|---|
| EP | 1605548 | A1 | 12/2005 |
| EP | 2 712 031 | A1 | 3/2014 |
| GB | 0412985 | | 6/2004 |
| GB | 0412985.4 | | 6/2004 |
| JP | 47-17382 | | 6/1972 |
| JP | 55-142892 | | 10/1980 |
| JP | 2-56367 | U | 4/1990 |
| JP | 2001-84845 | A | 3/2001 |
| JP | 2002-246104 | A | 8/2002 |
| JP | 2002-289307 | | 10/2002 |
| JP | 2004-172009 | A | 6/2004 |
| JP | 2006-31962 | A | 2/2006 |
| JP | 2007-227256 | A | 9/2007 |

OTHER PUBLICATIONS

Written Opinion dated Jul. 24, 2012 issued in International Application No. PCT/JP2012/066052 (PCT/ISA/237).

Search Report dated Feb. 16, 2015 issued by the European Patent Office in counterpart European Patent Application No. 12801813.2.

Office Action dated Jan. 20, 2015 issued by the Japanese Patent Office in counterpart Japanese Patent Application No. 2011-139425.

Office Action dated May 6, 2015, issued by the State Intellectual Property Office of P.R. China in counterpart Chinese Application No. 201280030933.4.

* cited by examiner

CONNECTOR

CROSS REFERENCE TO RELATED APPLICATIONS

This application is a continuation of PCT application No. PCT/JP2012/066052, which was filed on Jun. 22, 2012 based on Japanese Patent Application (No. 2011-139425) filed on Jun. 23, 2011, the contents of which are incorporated herein by reference.

BACKGROUND OF THE INVENTION

1. Field of the Invention

The present invention relates to a connector which connects to wire cables to a mounting part of an electronic device or the like.

2. Background Art

Devices such as a motor or an inverter, which converts DC (direct current) power from a battery into AC (alternating current) power and supplies the power to the motor, are loaded in a hybrid car or an electric vehicle. A device connector structure, which is used to connect wires to the device, is known which includes a terminal block which is provided inside a case of the device and holds a plurality of device side terminals which are connected to a device main body, and a wire side connector which holds a plurality of wire side terminals to a wire side housing, and which attaches the wire side connector to the terminal block to connect the wire side terminals and the device side terminals (refer to Patent Document 1).

Patent Document 1: JP-A-2006-31962

SUMMARY OF THE INVENTION

A waterproofing structure is necessary for a place where the device and the connector are connected. For this purpose, a sealing member is embedded in a sealing groove of the connector, and when the connector is installed into the device, the sealing member is adhered to the device to secure sealing performance. Since it is necessary to perform the sealing of the device around the entire periphery of the mounting place, it is preferable that the connector is downsized in order to improve the sealing performance.

The present invention is made in view of the above situations, and an object of the present invention is to provide a connector which is downsized so that the sealing performance to a connection counterpart can be improved.

In order to achieve the purpose described above, a connector according to the invention is characterized by the following (1) to (3).

(1) A connector comprising:

a plurality of connection terminals to which cables are connected;

a housing holding the connection terminals;

an installing part, formed by a part of the housing, and fitted into a mounting hole of a connection counterpart; and a sealing member, provided in the installing part, and sealing between the installing part and the mounting hole, wherein connecting tab parts provided in the connection terminals are connected to a terminal block provided at the connection counterpart side, and wherein the connection terminals includes a confluent connection terminal including a plurality of cable connecting parts to which a plurality of the cables are connected and one of the connecting tab parts.

(2) The connector according to the above (1), wherein the cable connecting parts and the connecting tab parts are arranged in a width direction of the housing respectively, and wherein intersection parts of the confluent connection terminal and the other of the connection terminals are disposed at different positions in a thickness direction of the housing.

(3) The connector according to the above (1) or (2), wherein the connection terminals are integrally formed with the housing by insert molding.

Because the connector of the above (1) includes the confluent connection terminal having a plurality of cable connecting parts to which a plurality of cables are connected and one connecting tab part, the housing which holds the connection terminals can be downsized. In particular, because the number of the connecting tab parts, which are connected to the terminal block at the connection counterpart side, is reduced, the installing part which is fitted into the mounting hole of the connection counterpart can be made smaller. Therefore, the area around the mounting hole sealed by the sealing member can be reduced, and sealing performance can be improved.

Because for the connector of the above (2), the intersection parts of the confluent connection terminal and another connection terminal are arranged at different positions in the thickness direction of the housing, insulation between the connection terminals is ensured, and the size in the width direction of the housing which is an arrangement direction of the cable connecting parts and the connecting tab parts can be downsized.

Because for the connector of the above (3), the connection terminals are integrally formed with the housing by insert molding, the connection terminals can be surely held in the housing, and excellent insulation between the connection terminals can be ensured.

According to the present invention, a connector can be provided which is downsized so that the sealing performance to a connection counterpart can be improved.

The present invention has been briefly described above. Further, details of the invention will become more apparent after the embodiments of the invention described below are read with reference to the accompanying figures.

BRIEF DESCRIPTION OF THE DRAWINGS

FIG. 5A is a perspective view from a front side of the connection terminals. FIG. 5B is a front view of the connection terminals.

FIG. 6A is a perspective view from a back side of the connection terminals. FIG. 6B is a back view of the connection terminals.

DETAILED DESCRIPTION OF THE EXEMPLARY EMBODIMENTS

Below, the embodiments of the invention are explained with reference to the figures.

Figure 1:
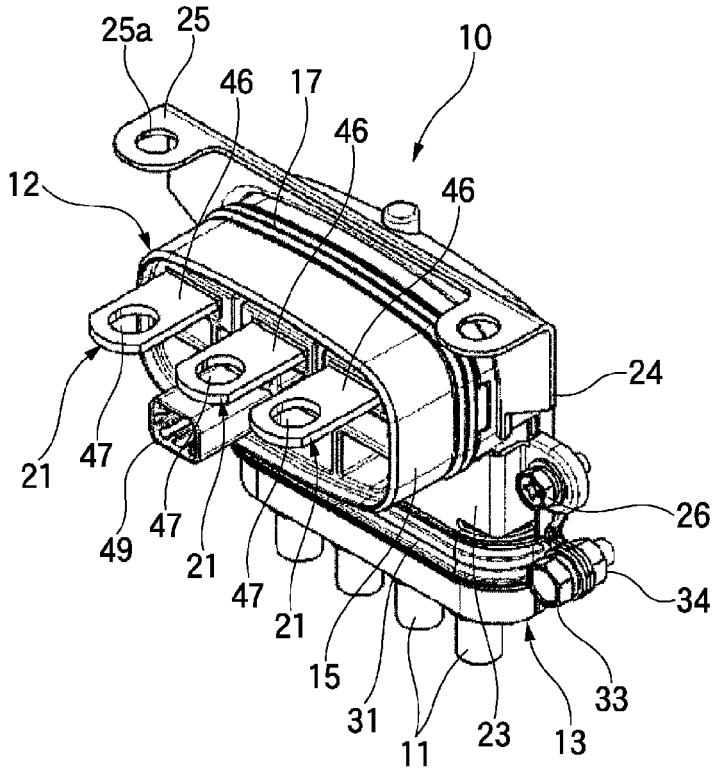
FIG. 1 is a perspective view of a connector according to the embodiment.
Figure 2:
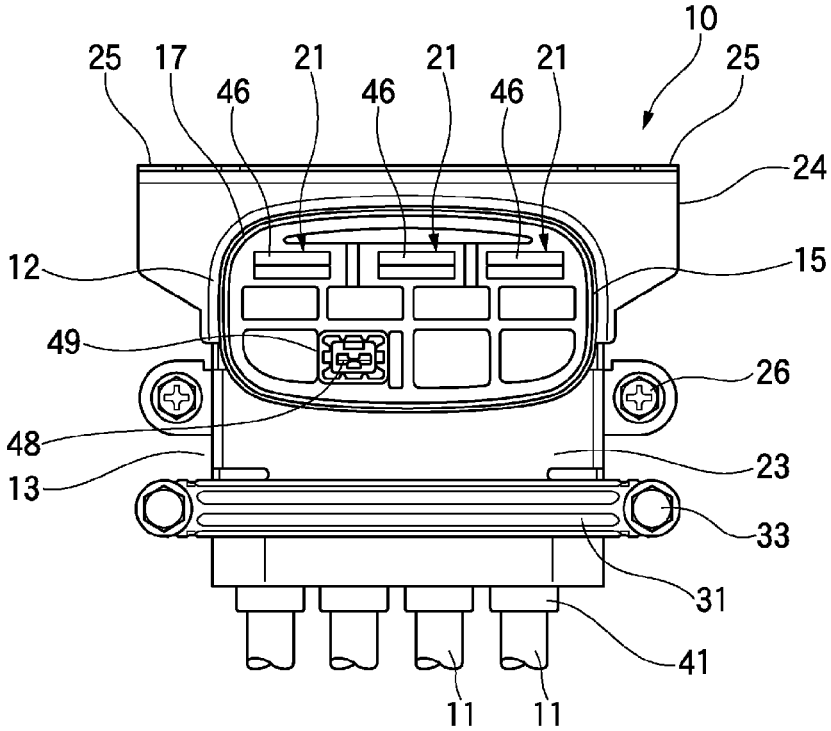
FIG. 2 is a front view of the connector according to the embodiment.
Figure 3:
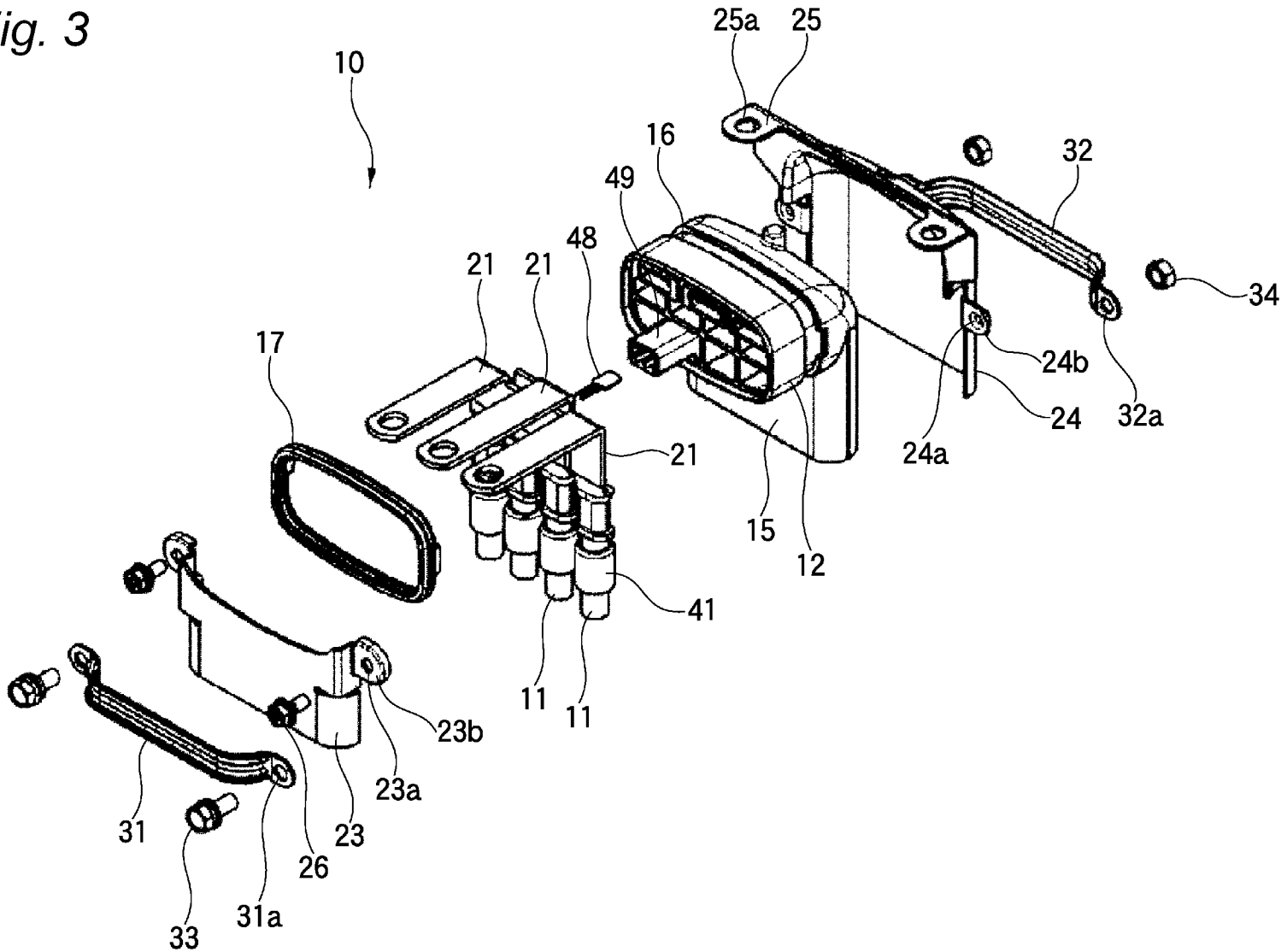
FIG. 3 is an exploded perspective view from the front side of the connector according to the embodiment.
Figure 4:
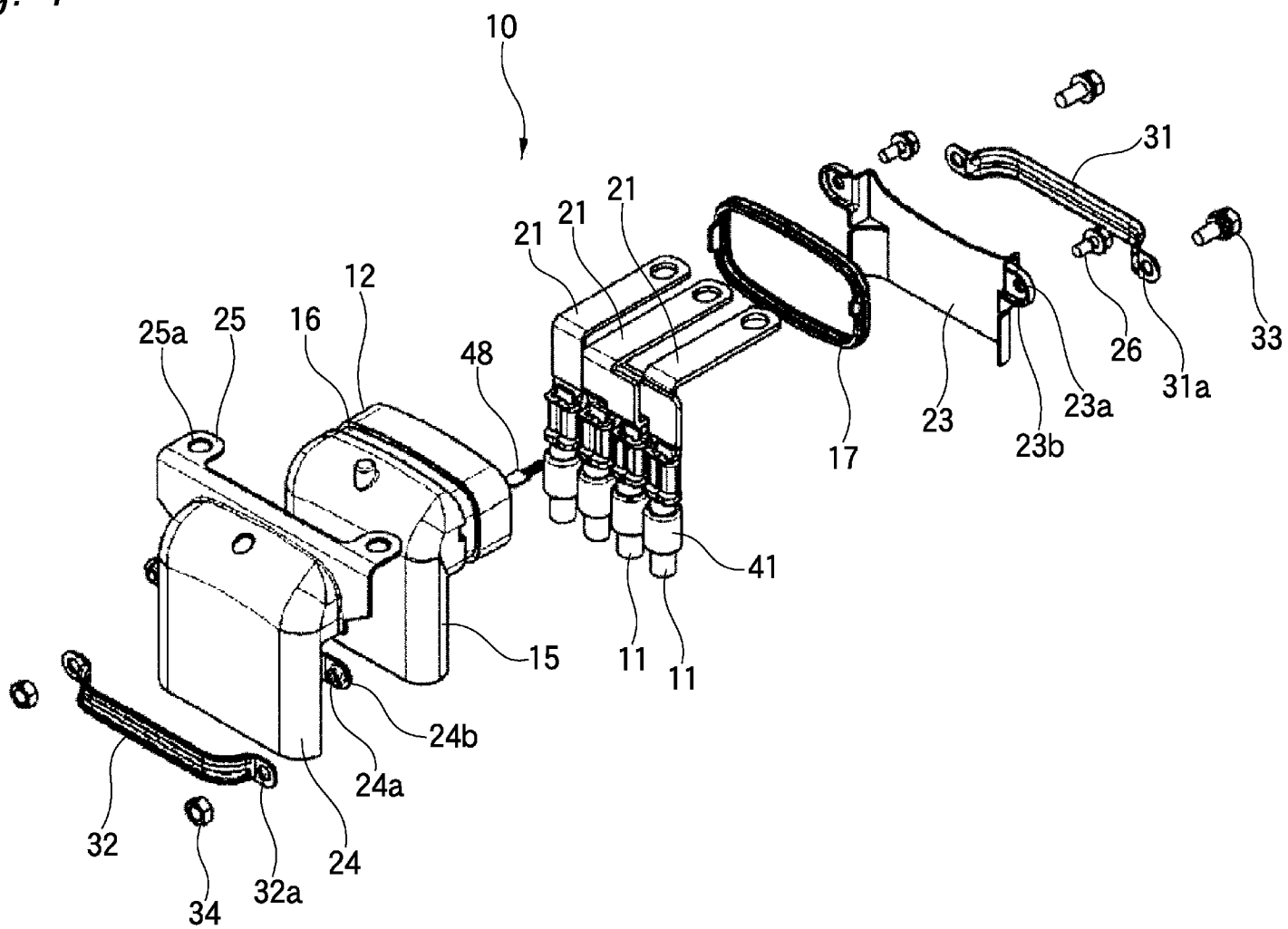
FIG. 4 is an exploded perspective view from the back side of the connector according to the embodiment.
Figure 5B:
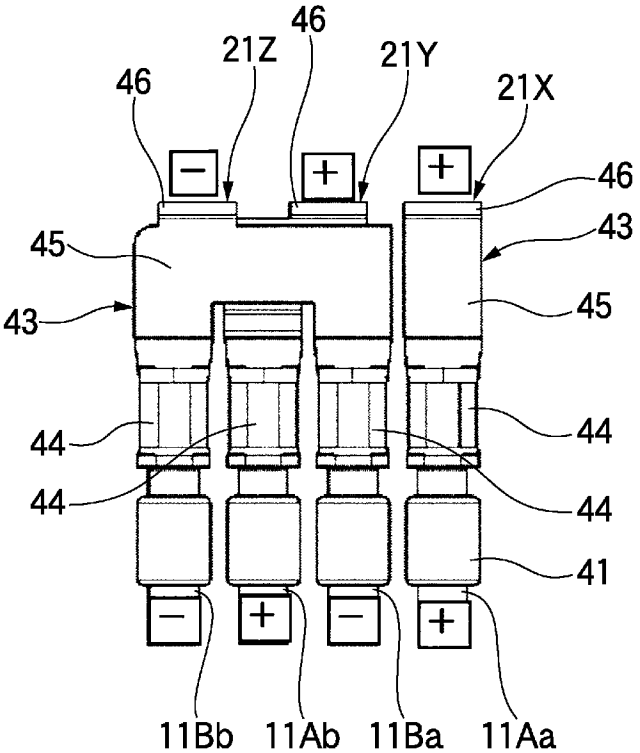
FIGS. 5A and 5B are views which show that connection terminals are held in a housing of the connector.
Figure 5A:
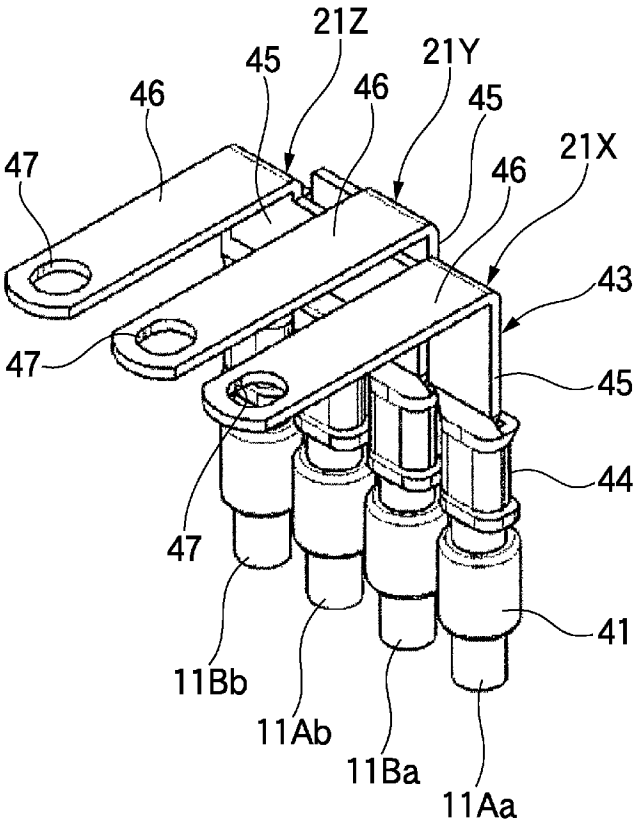
Figure 6B:
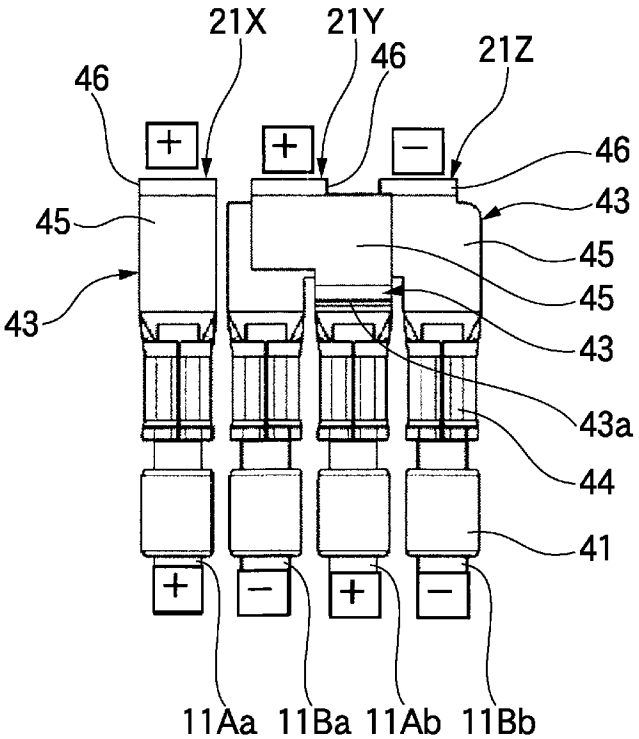
FIGS. 6A and 6B are views which show that the connection terminals are hold in the housing of the connector.
Figure 6A:
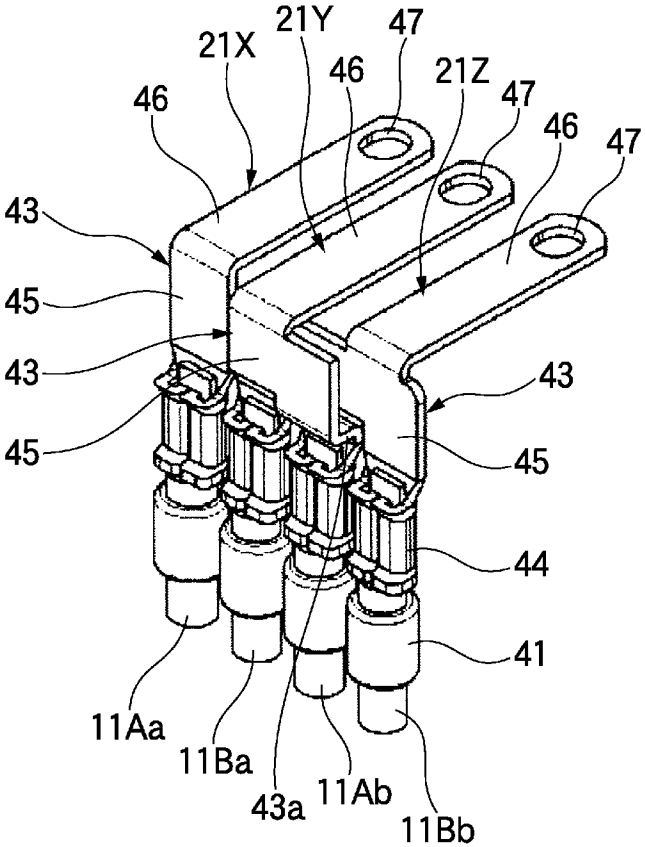
Figure 7:
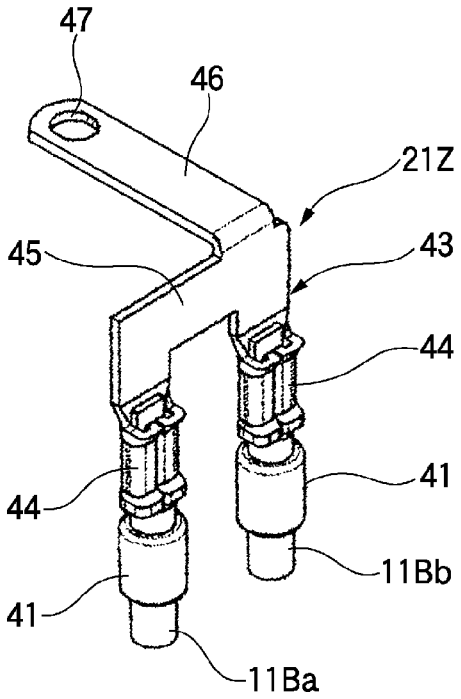
FIG. 7 is a perspective view from a back side of a confluent connection terminal.

FIG. 1 is a perspective view of a connector according to the embodiment. FIG. 2 is a front view of the connector according to the embodiment. FIG. 3 is an exploded perspective view from the front side of the connector according to the embodiment. FIG. 4 is an exploded perspective view from the back side of the connector according to the embodiment. FIGS. 5A and 5B are views which show that connection terminals are held in a housing of the connector. FIG. 5A is a perspective view from a front side of the connection terminals, and FIG. 5B is a front view of the connection terminals. FIGS. 6A and 6B are views which show that the connection terminals are hold in the housing of the connector. FIG. 6A is a perspective view from a back side of the connection terminals, and FIG. 6B is a back view of the connection terminals. FIG. 7 is a perspective view from a back side of a confluent connection terminal.

As shown in FIGS. 1 and 2, a connector 10 according to the present embodiment is a high-voltage connector which is connected to a motor, an inverter or the like. The connector 10 is installed to the case of a device such as the inverter which is a connection counterpart, so as to connect cables 11. The connector 10 includes an installing part 12 which is fitted into a mounting hole (not shown in the figure) formed in the case of the device and a cable guiding part 13 which guides a plurality of (in the present embodiment, four) cables 11. The connector 10 is formed into an L-like shape when viewed from the side.

As shown in FIGS. 3 and 4, the connector 10 includes a housing 15. The housing 15 is molded of synthetic resin. In the housing 25, a plurality of connection terminals 21 are insert-molded.

The housing 15 is formed with a sealing groove 16 along a circumferential direction at the installing part 12. A sealing member 17, which is formed into a circular shape, is installed into the sealing groove 16.

Shield shells 23 and 24 which are formed of metal material, are installed to the housing 15 from an installing side at which the connector 10 is installed to the mounting hole and from a side opposite to the installing side of the connector 10, respectively. By the shield shells 23 and 24, parts of the housing 15 around the cable guiding part 13 are covered and shielded. The shield shell 23 is formed with fixing pieces 23*b* which have hole parts 23*a*, and the shield shell 24 is formed with fixing pieces 24*b* which have screw holes 24*a*. By inserting screws 26 into the hole parts 23*a* and the screw holes 24*a*, the shield shells 23 and 24 are installed to the cable guiding part 13.

In addition, the shield shell 24 is formed with attaching pieces 25 which have hole parts 25*a*. When the installing part 12 of the connector 10 is fitted into the mounting hole of the case of the device, screws (not shown in the figure) are inserted into the hole parts 25*a* and are screwed into screw holes (not shown in the figure) at the device side so that the shield shell 24 is electrically connected to the case of the device.

Shield bands 31 and 32, which are formed of metal material, are installed to the shield shells 23 and 24 which are installed to the housing 15, from the installing side at which the connector 10 is installed to the mounting hole and from the side opposite to the installing side of the connector 10, respectively. With these shield bands 31 and 32, shield layers such as braid or metal foil (not shown in the figure) which are provided to shield the cables 11 are fixed to the shield shells 23 and 24 so as to be electrically connected to the shield shells 23 and 24. The shield bands 31 and 32 are formed with hole parts 31*a* and 32*a* at two end parts. When screws 33 are inserted into the hole parts 31*a* and 32*a* and are screwed into nuts 34, the shield bands 31 and 32 are installed to the shield shells 23 and 24, and the shield layers of the cables 11 are held between the shield shells 23 and 24 to be fixed.

The cables 11 are connected to the connection terminals 21 which are insert-molded in the housing 15. The cable 11 has such a structure that a conductor is coated with insulate resin. When the connection terminal 21 is crimped to one end part of the cable 11, the connection terminal 21 is electrically connected to the conductor and the cable 11 is fixed.

In addition, a seal rubber 41 is fixed to the cable 11 near where the connection terminal 21 is connected to the cable 11. A part of the seal rubber 41 is integrally connected to the housing 15 by being insert-molded, and therefore, the gap between the cable 11 and the housing 15 is surely sealed.

As shown in FIGS. 5A to 6B, the cables 11 have two positive pole cables 11Aa and 11Ab and two negative pole cables 11Ba and 11Bb. The positive pole cables 11Aa and 11Ab, and the negative pole cables 11Ba and 11Bb are alternately arranged.

The central part of the connection terminal 21 is bent, and the distal end of the connection terminal 21 extends toward the installing side which the connector 10 faces when the connector 10 is installed to the mounting hole. Therefore, the connection terminal 21 includes a crimp connecting part 43 to which the cable 11 is connected, and a connecting tab part 46 which extends along the installing part 12. The crimp connecting part 43 includes a cable crimping part (cable connecting part) 44 which crimps and fixes the conductor of the cable 11, and a connecting plate part 45 between the cable crimping part 44 and the connecting tab part 46. In addition, the connecting tab part 46 is formed with a fastening hole part 47 near the distal end.

The connection terminals 21 include two positive pole connection terminals 21X and 21Y, and one negative pole connection terminal 21Z. The positive pole cables 11Aa and 11Ab are connected to the positive pole connection terminals 21X and 21Y respectively, and the negative pole cables 11Ba and 11Bb are connected to the negative pole connection terminal 21Z.

In the positive pole connection terminal 21X, the connecting plate part 45 of the crimp connecting part 43 extends along the cable 11. In contrast, in the positive pole connection terminal 21Y, the connecting plate part 45 of the crimp connecting part 43 extends in a direction perpendicular to the cable 11. The crimp connecting part 43 of the positive pole connection terminal 21Y is formed with a step part 43*a* between the cable crimping part 44 and the connecting plate part 45. Therefore, the connecting plate part 45 of the positive pole connection terminal 21Y is arranged at the side opposite to the installing side at which the connector 10 is installed to the mounting hole. In other words, the connecting plate part 45 of the positive pole connection terminal 21Y is arranged at the back side, opposite to the connecting tab part 46, of the connecting plate part 45 of the negative pole connection terminal 21Z.

As shown in FIG. 7, the negative pole connection terminal 21Z has two cable crimping parts 44 which are arranged to be spaced, and the cable crimping parts 44 are connected with each other by the connecting plate part 45. The connecting plate part 45 of the negative pole connection terminal 21Z extends in a direction perpendicular to the cable 11, and one connecting tab part 46 extends from the connecting plate part 45. Thus, the negative pole connection terminal 21Z is a confluent connection terminal which includes a plurality of cable crimping parts 44 to which a plurality of cables 11 are connected and one connecting tab part 46.

The cable crimping part 44 of the positive pole connection terminal 21Y is arranged in a gap between the two cable crimping parts 44 of the negative pole connection terminal 21Z which is the confluent connection terminal. In the positive pole connection terminal 21Y, because of the step part 43*a* formed in the gap between the cable crimping part 44 and the connecting plate part 45, the connecting plate part 45 is arranged to the side opposite to the installing side at which the connector 10 is installed to the mounting hole. That is, the intersection parts of the negative pole connection terminal 21Z and the positive pole connection terminal 21Y are arranged at different positions in a thickness direction of the housing 15 (in other words, a direction perpendicular to a plane in which the cable crimping parts 44 of the negative pole connection terminal 21Z and the cable crimping part 44 of the positive pole connection terminal 21Y are arranged side by side). Therefore, the connecting plate part 45 of the negative pole connection terminal 21Z and the connecting plate part 45 of the positive pole connection terminal 21Y are arranged to be spaced without contacting each other.

While these four cable crimping parts 44 are arranged side by side at equal intervals, and these three connecting tab parts 46 are arranged side by side at equal intervals, the connection terminals 21 including the above positive pole connection terminals 21X, 21Y and the negative pole connection terminal 21Z are insert-molded to the housing 15. Therefore, the distal ends having the fastening hole parts 47 of the connecting tab parts 46 of the connection terminals 21 protrude from the installing part 12 of the housing 15.

When the connection terminal 21 is to be insert-molded, first, the cables 11 are crimped and connected to the cable crimping parts 44 of the connection terminals 21, and the cables 11 are formed with the seal rubbers 41 by molding. In this state, the connection terminals 21 are set into a die for molding the housing 15, and resin is injection-molded to the die. Therefore, the housing 15 in which the connection terminals 21 are insert-molded is obtained.

In this way, when the connection terminals 21 are integrated with the housing 15 by insert molding, the resin enters into gaps between the connection terminals 21. Therefore, the connection terminals 21 are surely held in the housing 15, and insulation between the connection terminals 21 is ensured without considering surface distances or the like.

In the connector 10, the installing part 12 of the housing 15 is formed with an interlock part 49 to which an interlock terminal 48 is connected.

In order to connect the connector 10 of the above structure to the device, the installing part 12 of the connector 10 is fitted into the mounting hole formed to the case of the device. In this way, when the installing part 12 is fitted into the mounting hole of a panel of the device, the sealing member 17 attached to the installing part 12 is adhered to the inner peripheral surface of the mounting hole, and both the device and the connector 10 are waterproofed.

Fastening bolts (not shown in the figure) are inserted into the fastening hole parts 47 of the three connecting tab parts 46 which protrude from the installing part 12, and the fastening bolts are screwed to connection terminals (not shown in the figure) of the terminal block provided inside the device. In this way, the connecting tab parts 46 are connected to the connection terminals of the terminal block, and the cables 11 and wires in the device which is connected to the connection terminal of the terminal block are electrically connected with each other.

Furthermore, when screws are inserted into the hole parts 25*a* of the attaching pieces 25 of the shield shell 24 and screwed into the screw holes at the device side, the shield shell 24 is electrically connected to the case of the device. Therefore, the shield shells 23 and 24, which coat the cable guiding part 13 arranged outside the device of the connector 10, are electrically connected to the device, and an excellent shielding effect is obtained.

Therefore, because the connector according to the embodiment includes the negative pole connection terminal 21Z including the confluent connection terminal having a plurality of cable crimping parts 44 to which a plurality of cables 11 are connected and one connecting tab part 46, the housing 15 which holds the connection terminals 21 can be downsized. In particular, because the number of the connecting tab parts 46 which are connected to the terminal block at the device side which are the connection counterpart is reduced, the installing part 12 which is fitted into the mounting hole can be made smaller. Therefore, the area around the mounting hole sealed by the sealing member 17 can be reduced, and sealing performance can be improved.

Because the intersection parts of the negative pole connection terminal 21Z which is the confluent connection terminal and the positive pole connection terminal 21Y which is another connection terminal are arranged at different positions in the thickness direction of the housing 15, insulation between the negative pole connection terminal 21Z and the positive pole connection terminal 21Y is ensured, and the size in the width direction of the housing 15 which is an arrangement direction of the connecting tab parts 46 and the cable crimping parts 44 can be downsized.

In addition, because the connection terminals 21 are integrally formed with the housing 15 by insert molding, the connection terminals 21 can be surely held in the housing 15, and excellent insulation between the connection terminals 21 can be ensured.

Figure 8:
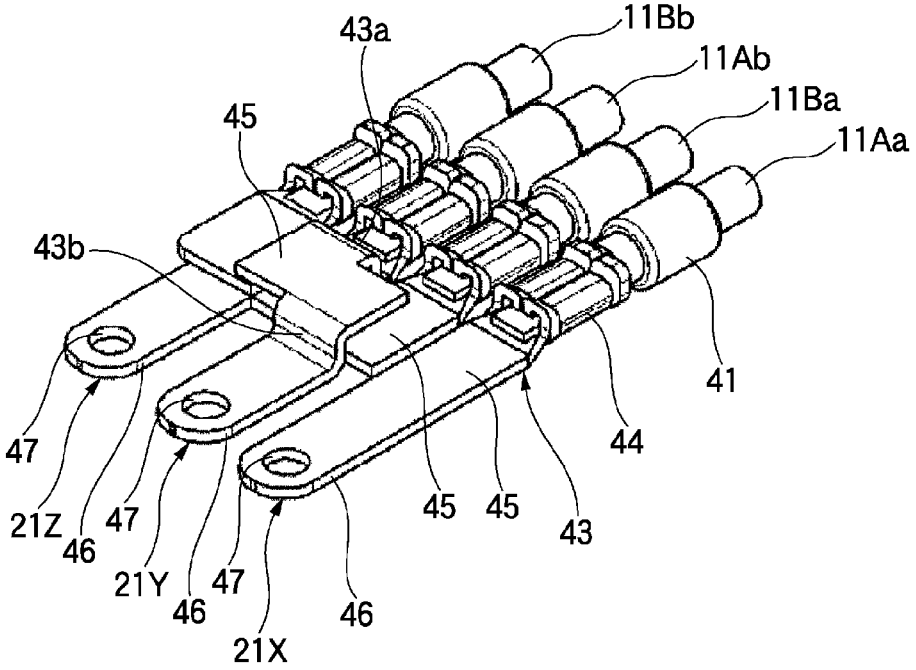
FIG. 8 is a perspective view of connection terminals of a variation.

Although the embodiment illustrates the connector for which the installing part 12 and the cable guiding part 13 are formed into an L-like shape when viewed from the side, the installing part 12 and the cable guiding part 13 may be formed into a straight line shape. In this case, as shown in FIG. 8, in the connection terminals 21, the connecting tab parts 46 extend along the longitudinal direction of the cables 11 to the crimp connecting parts 43. In addition, the positive pole connection terminal 21Y is formed with a step part 43*b* between the connecting plate part 45 and the connecting tab part 46, and the connecting plate part 45 of the positive pole connection terminal 21Y does not contact the connecting plate part 45 of the negative pole connection terminal 21Z, but is arranged to be spaced.

Figure 9:
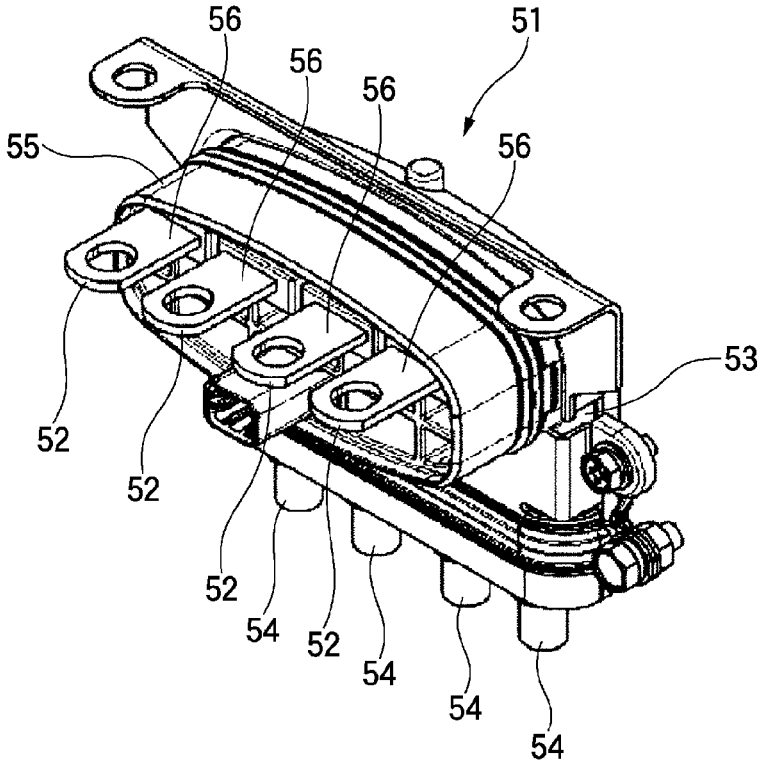
FIG. 9 is a perspective view of a connector according to a reference example.
Figure 10:
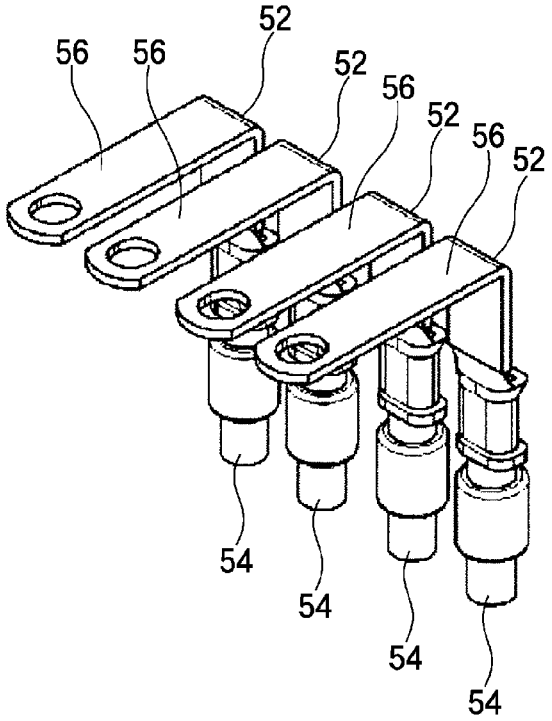
FIG. 10 is a perspective view of connection terminals according to the reference example.

In order to further describe the superiority of the present invention, a reference example is shown in FIGS. 9 and 10.

FIG. 9 is a perspective view of a connector according to the reference example, and FIG. 10 is a perspective view of connection terminals according to the reference example.

As shown in FIGS. 9 and 10, a connector 51 according to the reference example has four connection terminals 52, and the connection terminals 52 are respectively connected to four cables 54 guided from a cable guiding part 53 and are arranged side by side. In the connector 51, connecting tab parts 56 of the connection terminals 52 are arranged to be spaced and protrude side by side from an installing part 55.

Because the connecting tab parts 56 of the connection terminals 52 which are connected to the cables 54 respectively are arranged side by side to be spaced, the connector 51 is made to be upsized. In particular, because the installing part 55 which is fitted into a mounting hole of a device is large, the sealed range around the mounting hole becomes large, and the sealing performance is deteriorated.

The present invention is not limited to the above described embodiment, and suitable modifications, improvements or the like can be made. Moreover, the materials, shapes, dimensions, numbers, installation places, and the like of the components in the above embodiment are arbitrarily set as far as the invention can be attained, and not particularly restricted.

Although the invention is described in detail with reference to the specific embodiment, it is apparent that various modifications and amendments may be made by those skilled in the art without departing from the spirit and scope of the invention.

The connector of the present invention achieves an effect which is that the sealing performance between the connector and a connection counterpart can be improved while the size of the connector is reduced, and is useful for connecting to wire cables to a mounting part of an electronic device or the like.

What is claimed is:

1. A connector comprising:

a plurality of connection terminals to which cables are connected;

a housing holding the connection terminals;

an installing part, formed by a part of the housing, and fitted into a mounting hole of a connection counterpart; and a sealing member, provided in the installing part, and sealing between the installing part and the mounting hole, wherein connecting tab parts provided in the connection terminals are connected to a terminal block provided at the connection counterpart side, and wherein the connection terminals includes a confluent connection terminal including a plurality of cable connecting parts to which a plurality of the cables are connected and one of the connecting tab parts.

2. The connector according to claim 1, wherein the cable connecting parts and the connecting tab parts are arranged in a width direction of the housing respectively, and wherein intersection parts of the confluent connection terminal and the other of the connection terminals are disposed at different positions in a thickness direction of the housing.

3. The connector according to claim 1, wherein the connection terminals are integrally formed with the housing by insert molding.

* * * * *